US007203280B2

(12) United States Patent
Anno et al.

(10) Patent No.: US 7,203,280 B2
(45) Date of Patent: Apr. 10, 2007

(54) X-RAY APPARATUS

(75) Inventors: Hidero Anno, Otawara (JP); Koichi Kitade, Otawara (JP); Takayuki Kitami, Nasu-gun (JP); Hironori Nakamuta, Otawara (JP); Manabu Sato, Nasu-gun (JP)

(73) Assignees: Kabushiki Kaisha Toshiba, Tokyo (JP); Toshiba Electron Tubes & Devices Co, Ltd., Tokyo (JP)

( * ) Notice: Subject to any disclaimer, the term of this patent is extended or adjusted under 35 U.S.C. 154(b) by 0 days.

(21) Appl. No.: 11/404,779

(22) Filed: Apr. 17, 2006

(65) Prior Publication Data

US 2006/0188069 A1 Aug. 24, 2006

Related U.S. Application Data

(63) Continuation of application No. PCT/JP2004/015385, filed on Oct. 18, 2004.

(30) Foreign Application Priority Data

Oct. 17, 2003 (JP) ..... 2003-358273

(51) Int. Cl.
*H01J 35/00* (2006.01)

(52) U.S. Cl. ..... 378/130; 378/141; 378/200

(58) Field of Classification Search ..... 378/119, 378/121–144, 199, 200; 174/15.1
See application file for complete search history.

(56) References Cited

U.S. PATENT DOCUMENTS 4,920,554 A * 4/1990 Gabbay et al. ..... 378/200
6,115,454 A * 9/2000 Andrews et al. ..... 378/140
6,362,415 B1 * 3/2002 Snyder et al. ..... 174/15.1
6,781,060 B2 * 8/2004 Radley ..... 174/84 R

FOREIGN PATENT DOCUMENTS

| | | | |
|---|---|---|---|
| JP | 58-164171 U | | 11/1983 |
| JP | 06-267690 | * | 9/1994 |
| JP | 2001-502473 | | 2/2001 |
| JP | 2003-197136 | | 7/2003 |
| WO | WO 02/082495 A1 | | 10/2002 |

OTHER PUBLICATIONS

Machine English language translation provided for JP 06-267690.*
International Search Report dated Feb. 15, 2005 for Appln. No. PCT/JP2004/015385.

* cited by examiner

*Primary Examiner*—Edward J. Glick
*Assistant Examiner*—Jurie Yun
(74) *Attorney, Agent, or Firm*—Pillsbury Winthrop Shaw Pittman, LLP

(57) ABSTRACT

The present invention relates to an X-ray apparatus comprising an electron radiation source which generates an electron to an anode, a shaft which rotatably supports the anode, a stator which generates a force to rotate a rotor shaft, an enclosure which maintains at least the anode, electron radiation source and rotor shaft in vacuum, and a housing which contains a cooling medium around the enclosure. The X-ray apparatus is characterized in that an electric wire material to supply power to the electron radiation source and stator, or a connector used for connection with the electric wire material is molded by a material having an electrical insulating property.

10 Claims, 5 Drawing Sheets

X-RAY APPARATUS

CROSS REFERENCE TO RELATED APPLICATIONS

This is a Continuation Application of PCT Application No. PCT/JP2004/015385, filed Oct. 18, 2004, which was published under PCT Article 21(2) in Japanese.

This application is based upon and claims the benefit of priority from prior Japanese Patent Application No. 2003-358273, filed Oct. 17, 2003, the entire contents of which are incorporated herein by reference.

BACKGROUND OF THE INVENTION

1. Field of the Invention

The present invention relates to an X-ray apparatus, and a rotary anode X-ray tube applied to an X-ray apparatus.

2. Description of the Related Art

An X-ray apparatus using a rotary anode X-ray tube is composed of a rotary anode X-ray tube main body which contains a rotatably supported anode target in a vacuum enclosure, a stator coil which supplies a driving magnetic field from the outside of the X-ray tube main body to a rotor connected to the anode target, and a housing which contains the X-ray tube main body and stator coil.

The space between the housing and rotary anode X-ray tube main body is filled with a cooling medium to radiate the heat generated from the anode target, for example, insulating oil and non-oil/fat cooling liquid including water as a main component. Namely, the heat from the anode target is radiated to the cooling medium, and the cooling medium is cooled by convection, and the heat is exhausted. As a result, a heating element such as an anode target is cooled. In this time, the heat generated from the stator coil is also exhausted, and the stator coil is cooled as a result. Cooling by using this kind of enclosed cooling medium is often adopted for a relatively small X-ray tube having sufficient heat capacity. (Refer to Jpn. UM Appln. KOKAI Publication No. 58-164171, for example.)

An example of using antifreeze solution having a high thermal conductivity among non-oil/fat cooling liquid as a cooling medium for the stator coil and rotary anode X-ray tube has been proposed. (Refer to PCT National Publication No. 2001-502473, for example.)

However, when oil/fat-based cooling liquid is used as a cooling medium, impregnant varnish used widely as an insulation coating material of a stator coil is eluted to the cooling medium, and the insulation of the stator and insulating oil themselves is lowered, and the life of an X-ray apparatus is reduced.

Further, when using non-oil/fat cooling liquid is used as a cooling medium, another problem arises. As the electrical conductivity of non-oil/fat cooling liquid is higher than that of oil/fat-based cooling liquid, the insulation of the stator coil must be ensured.

BRIEF SUMMARY OF THE INVENTION

It is an object of the present invention to maintain the characteristics of an X-ray apparatus which cools a rotary anode X-ray tube by using a cooling medium, stable for a long period.

The present invention thereis provided an X-ray apparatus comprising:

an anode target which generates X-rays;

an electron radiation source which generates an electron to the anode target;

a rotor which is connected to the anode target;

a stator coil which generates a driving force to rotate the rotor;

an enclosure which maintains at least the anode target, electron radiation source and rotor in a specified vacuum;

a housing which is configured to contain a cooling medium around the enclosure; and an electric wire material which supplies power to the electron radiation source and stator coil, wherein a molding material is provided at a specified position to prevent the cooling medium contacting the electric wire material.

Also, the present invention thereis provided an X-ray apparatus characterized by comprising:

a rotary anode target;

an electron radiation source which generates an electron to the rotary anode target;

a rotor which is connected to the rotary anode target;

a stator coil which generates a driving force to rotate the rotor;

an enclosure which maintains at least the rotary anode target, electron radiation source and rotor in specified vacuum;

a housing which is configured to contain a cooling medium around the enclosure;

an electric wire material which supplies power to the electron radiation source and stator coil, or a connector used for connection with the electric wire material; and a molding material which prevents the cooling medium contacting the electric wire material, connector or any area of the stator coil.

Further, the present invention thereis provided an X-ray apparatus characterized by comprising a rotary anode target; an electron radiation source which generates an electron to the rotary anode target; a rotor which is connected to the rotary anode target; a stator coil which generates a driving force to rotate the rotor; an enclosure which maintains at least the anode target, electron radiation source and rotor in specified vacuum; a housing which is configured to contain a cooling medium around the enclosure; and an electric wire material which supplies power to the electron radiation source and stator coil, or a connector used for connection with the electric wire material, wherein the electric wire material and connector or any area of the stator coil are molded by a material having electrical insulating property.

DETAILED DESCRIPTION OF THE INVENTION

Hereinafter, an embodiment of the present invention will be explained in detail with reference to the accompanying drawings.

Figure 1:
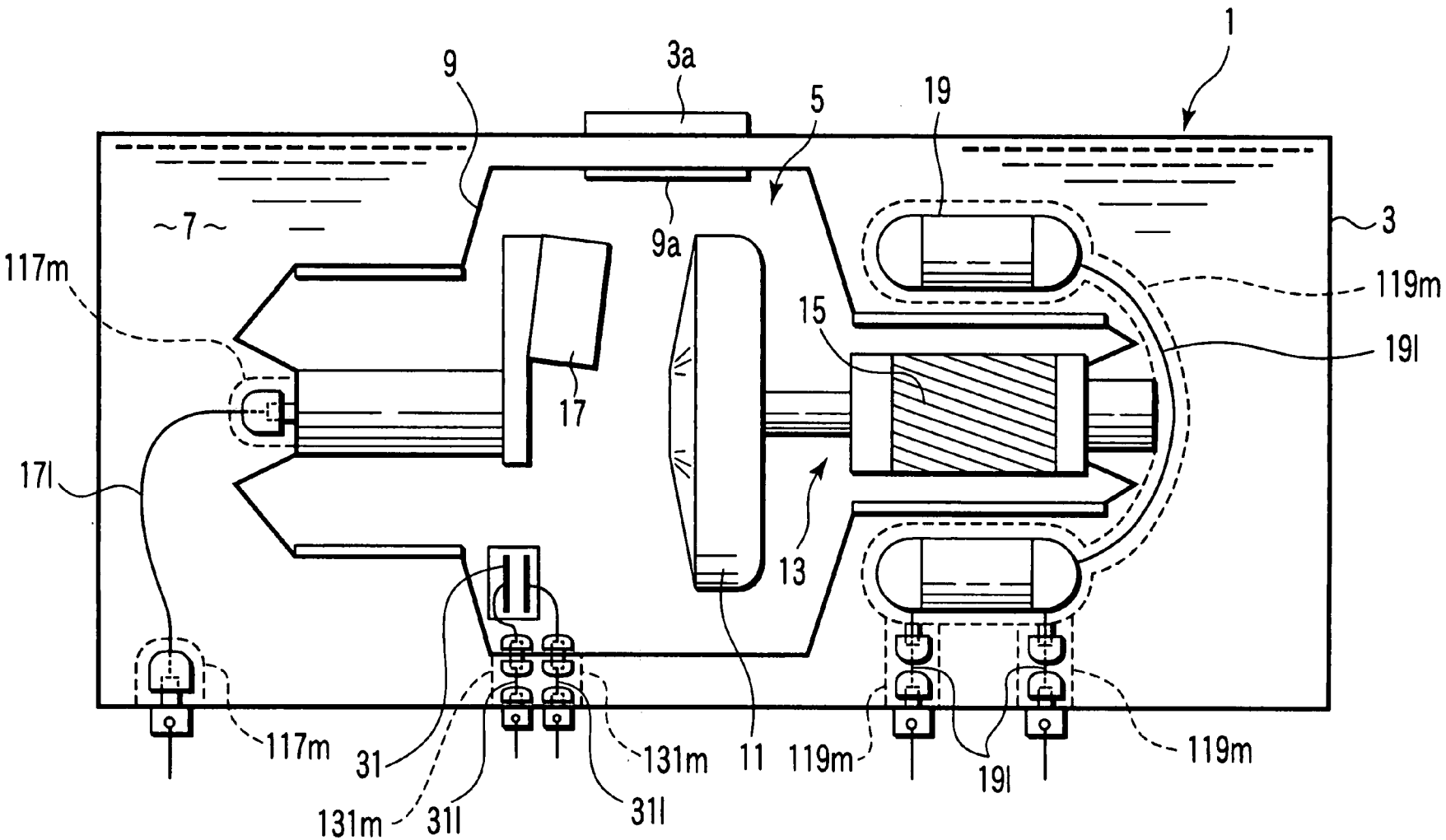
FIG. 1 is a schematic diagram explaining an example of an X-ray apparatus, to which an embodiment of the present invention is applicable.

As shown in FIG. 1, an X-ray apparatus 1, which is incorporated in an X-ray image diagnostic apparatus or a non-destructive inspection apparatus, for example, and radiates X-rays to be applied to an object or an inspection object, has a housing 3, and an X-ray tube main body (rotary anode X-ray tube) 5 capable of radiating X-rays with specified intensity to a specified direction.

The X-ray tube main body 5 is housed at a specified position in the housing 3 through non-oil/fat cooling liquid 7 which includes water as a main component and has an electrical conductivity controlled to lower than a specified value. Well-known insulating oil is usable as the cooling liquid 7.

The X-ray tube main body 5 has an enclosure 9 to maintain the interior vacuum, a cathode electron gun (a thermion radiation source) 17 provided at a specified position in the enclosure 9, a rotary anode (anode target) 11 to radiate X-rays with a specified wavelength when an electron from the electron gun 17 impinges, a rotor 15 connected to the anode target 11 (also called a rotary unit 13 including the rotor 15 and target 11), a stator coil 19 to supply a driving force or a magnetic field to rotate the rotor 15, and a getter 31 to capture the gas (hydrogen gas) generated inside in order to maintain the enclosure 9 in specified vacuum. At a specified position of the enclosure 9, a window 9*a* made of beryllium for example is provided to emit the X-rays radiated from the rotary anode 11 to the outside.

In the X-ray tube main body 5, power supply lines or electric wire materials 17I, 19I and 31I for supplying power to the cathode electron gun 17, stator coil 19 and getter 31 are used for electrical connection between a terminal (also indicated as a connector or contact) provided in each electric wire material and a corresponding terminal provided in the housing 3. Each electric wire material may be extended to the outside of the housing 3 without using a terminal.

A part of the electric wire material 17I, 19I or 31I to be connected to a corresponding terminal, that is, a part of the electric wire material where a conductor is exposed or a part of a terminal of each electric wire material where a base material is exposed, is molded (coated) by resin (hereinafter, called a molded part, and denoted by adding 100 and m to a reference numeral). As the resin material used for each molded part, materials with high heat resistance and chemical resistance, such as epoxy resin and fluorine resin are preferable.

Each molded part 117*m*, 119*m* or 131*m* is formed close to at least the holes of the housing 3 and enclosure 9 or around a not-shown connector, to prevent penetration of the cooling liquid into the enclosure 9. Namely, all areas of the electric wire materials to come in contact with the cooling liquid 7 may be molded.

Particularly, when the electric wire material for the stator coil 19 is impregnant varnish, for example, having the possibility of penetrating the cooling liquid 7, a molding material may be used in all areas around the stator coil 19 (The stator coil 19 may be completely coated with a molding material.) Molding the stator coil 19 decreases the noise (electromagnetic noise) generated when a current flows in the stator coil 19.

As a stator coil molding material, it is preferable to have the above-mentioned resin dispersed with powder of a material having an electrical insulation and thermal conductivity higher than resin, for example, alumina (aluminum oxide), aluminum nitride and boron nitride.

By coating the electric wire material (power supply line) immersed in the cooling liquid or around the connector with a molding material having high electrical insulation as described above, the degree of freedom of the material of the medium usable as cooling liquid can be increased. In this case, glycol, such as ethylene glycol and propylene glycol, and mixture of water and glycol, are usable as a cooling medium.

Figure 2:
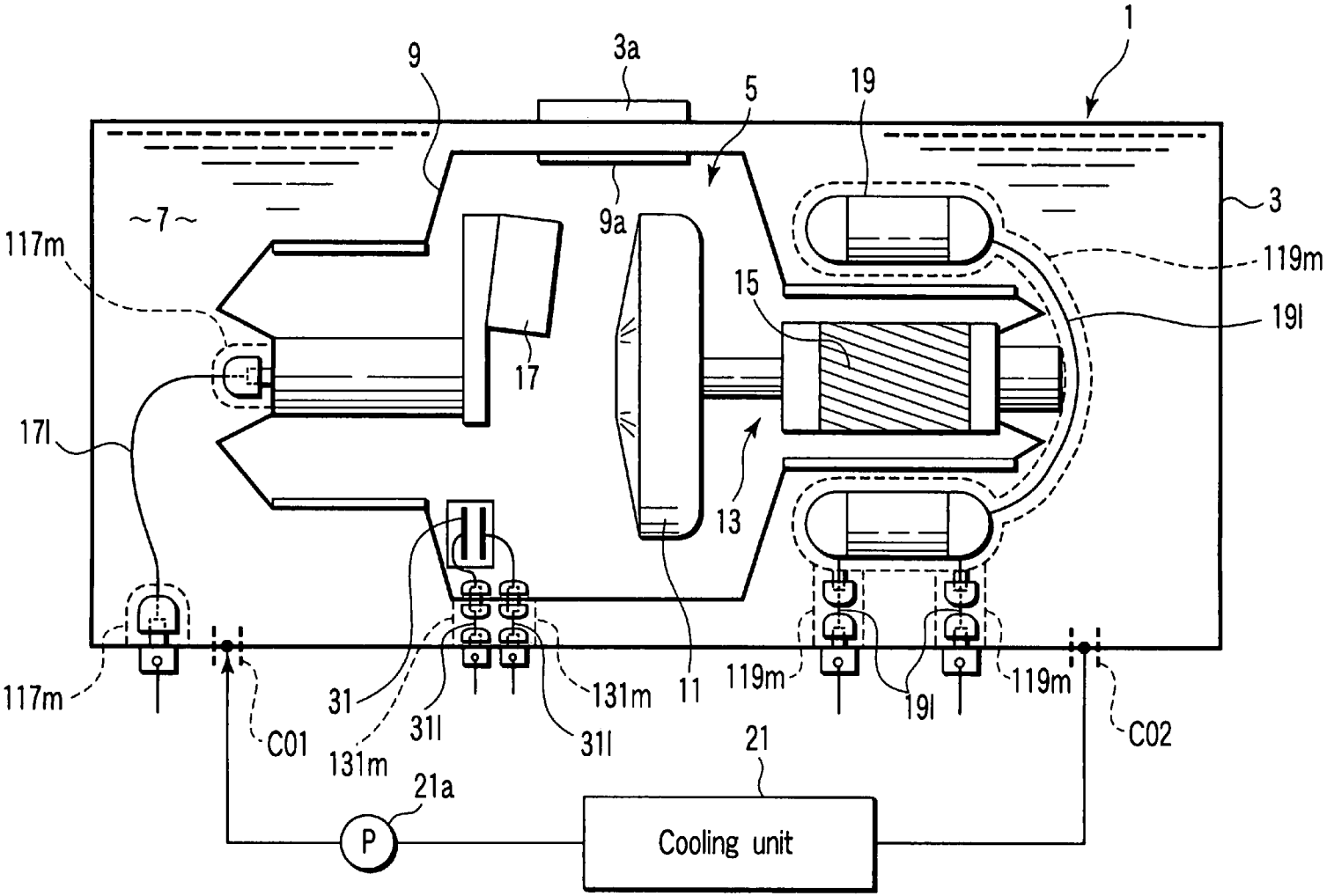
FIG. 2 is a schematic diagram explaining another example of an X-ray apparatus, to which an embodiment of the present invention is applicable.
Figure 3:
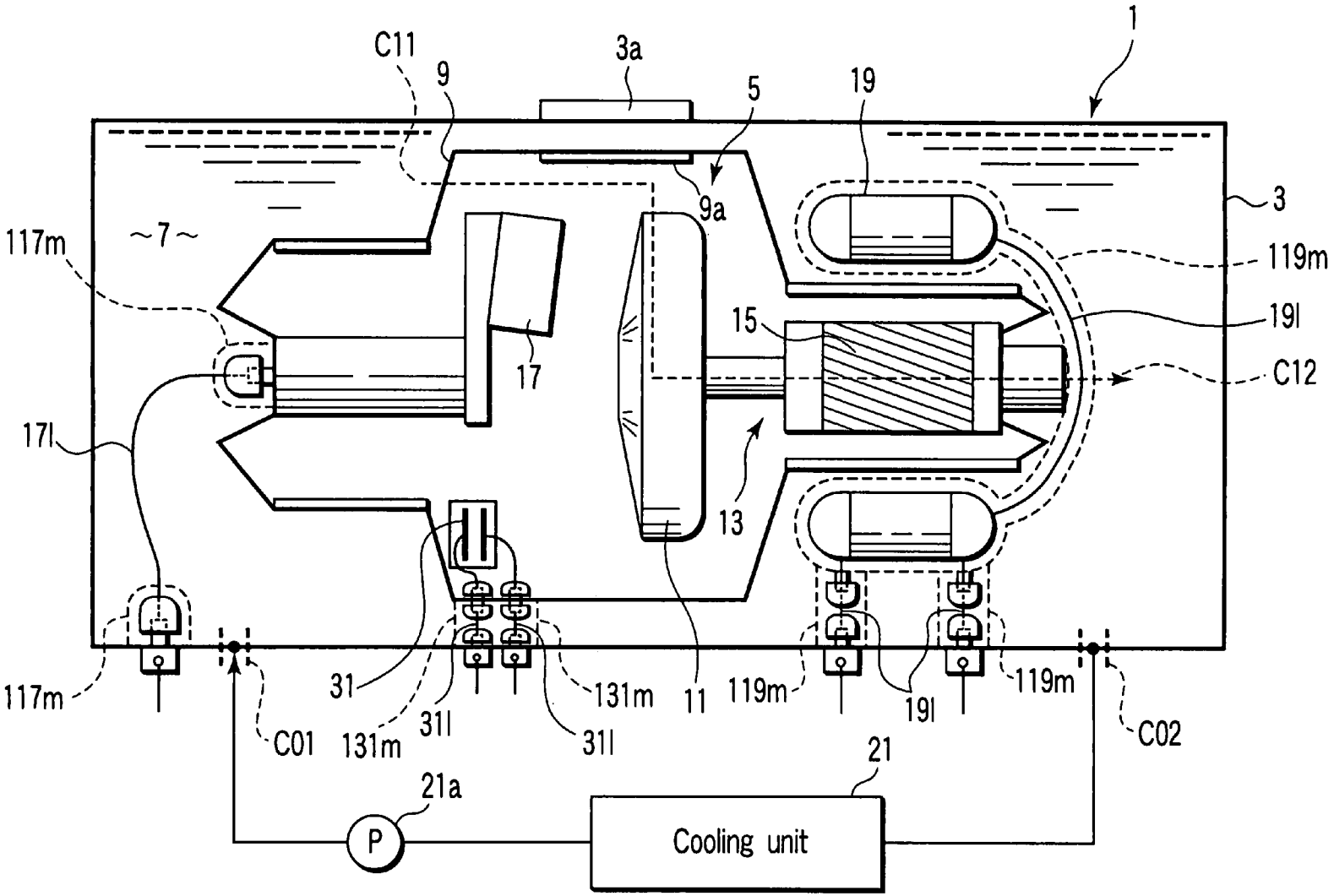
FIG. 3 is a schematic diagram explaining a further example of an X-ray apparatus, to which an embodiment of the present invention is applicable.

FIG. 2 and FIG. 3 are schematic diagrams explaining another embodiment of an X-ray apparatus including a rotary anode X-ray tube shown in FIG. 1. The same components as those explained in FIG. 1 are given the same reference numerals, and a detailed explanation will be omitted.

As shown in FIG. 2, the X-ray tube main body 5 is housed at a specified position in the housing 3 through non-oil/fat cooling liquid 7 which includes water as a main component and has an electrical conductivity controlled to be lower than a specified value. Well-known insulating oil is usable as the cooling liquid 7.

The cooling liquid 7 filled in the housing 3 is cooled by a cooling unit 21 which is provided at a specified position on the outside of the housing 3 and forcibly cools the cooling liquid 7, through first and second connectors C01 and C02 provided at specified positions of the housing. At the same time, the cooling liquid 7 is circulated at a specified flow rate between the housing 3 and the cooling unit 21, by a pump 21*a* which is incorporated integrally with the cooling unit 21 or provided at any position in the route of flowing the cooling liquid 7. The pump 21*a* is preferably a gear pump.

Therefore, the heat generated in the stator coil 19 or enclosure 9, particularly in the vicinity of the anode target 11 is exhausted to the cooling unit 21 through the cooling liquid 7. Even if an X-ray tube with a large X-ray output is incorporated, the X-ray tube can be efficiently cooled. This can provide the X-ray apparatus 1 with stable characteristics and the capability of maintaining stable characteristics for a long period.

As shown in FIG. 3, the cooling liquid 7 circulated by the cooling unit 21 and pump 21*a* may also be circulated in the anode target 11 having the highest heating value, electron gun 17, recoil electron capture trap (shielding structure) 23 and rotor 15 provided around the electron gun 17, through a cooling liquid flow path C11 or C12, for example.

In this time, the cooling liquid circulated in the enclosure 9 and the cooling liquid circulated between the enclosure 9 and housing 3 may be the same cooling liquid.

Figure 4:
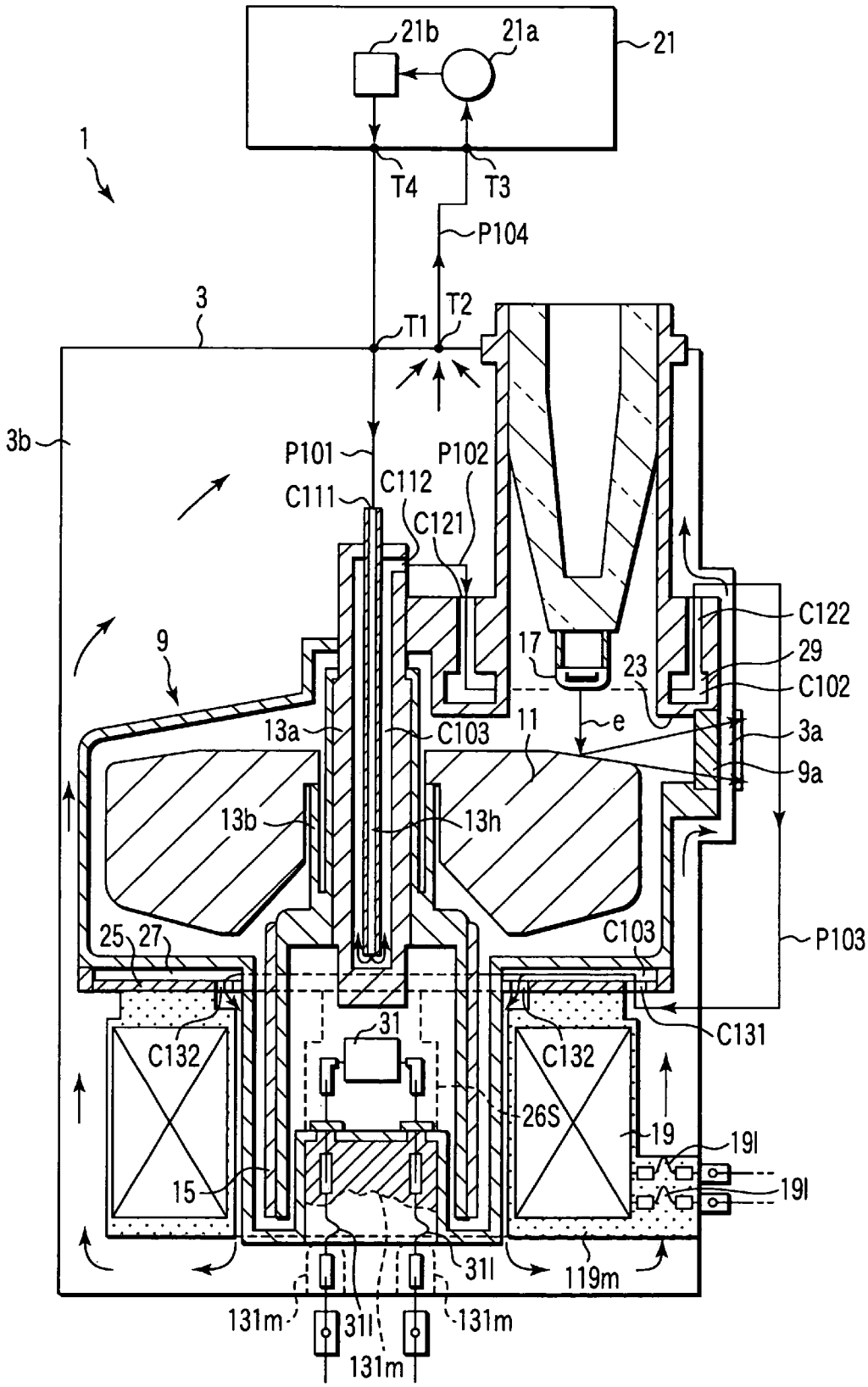
FIG. 4 is a schematic diagram explaining an example of a cooling system (using a non-oil/fat cooling medium only) applicable to the X-ray apparatus explained in FIG. 1 to FIG. 3.

FIG. 4 shows an example of a cooling system, which efficiently cools the anode target in the X-ray tube main body of the X-ray apparatus shown in FIG. 3, and the shaft of a rotary unit consisting of the anode target and rotor.

As shown in FIG. 4, the cooling liquid 7 fed from the pump 21*a* of the cooling unit 21 is cooled by a heat exchanger 21*b*, and guided to a pipe 13*h* of a fixed shaft 13*a* of the rotary unit 13 of the anode target 11 through a pipe P101, via a connection point T4 and a connection point T1 of the housing 3. A cooling medium flow path is provided close to at least a part of the X-ray tube main body 5, and composed of a first cooling path C101 including the pipe P101, a second cooling path C102, and a third cooling path C103.

The second cooling path C102 guides the cooling medium 7 to the vicinity of the electron gun 17 and the recoil electron capture trap 23, and guides the cooling medium 7 from the recoil electron capture trap 23 to a circular space 27 formed at a position opposite to the rear side of the anode target. The cooling medium 7 is ejected from the outlet port C132 of the circular space 27, and returned to the cooling unit 21 through the internal space 3*b* of the housing 3.

More specifically, in the X-ray apparatus shown in FIG. 4, the flow path to be supplied with the cooling medium is connected from a radiator 21*b* of the cooling unit 21 directly to the pipe 13*h* of the fixed shaft 13*a* of the rotor 15 through the pipe P101 (an inlet port C111, the first cooling path C101).

The cooling medium guided to the pipe 13*h* is guided to a pipe P102 from the periphery of the inlet port C111 and outlet port C112 provided nearby, through a hollow in the fixed shaft 13, or a space formed between the pipe 13*h* and shaft 13*a* provided in the cylindrical fixed shaft 13*a*. The cooling medium is further guided to the second cooling path C102 provided around the cathode 17 or in the vicinity of the recoil electron capture trap 23 and anode target 11. Namely, the cooling medium circulating in the fixed shaft 13*a* is guided from the inlet port C121 to the vicinity of the recoil electron capture trap 23, and ejected to the outlet port C122.

The cooling medium circulating in the recoil electron capture trap 23 is guided through the pipe P103 to an inlet port C131 of the third cooling path C103 defined as the circular space 27, which is formed by a wall 25 formed outside the vacuum enclosure 9 and close to the stator coil 19, in a form surrounding the enclosure 9 and crossing a not-shown rotary shaft of the rotary unit 13.

The circular space 27 is connected to the outlet port C132 formed at a position of 180° from the inlet port C131 holding the central part therebetween.

The cooling medium is led from the inlet port C131 into the circular space 27, and exhausted from the outlet port C132 to the internal space of the housing 3. Therefore, the internal space 3*b* of the housing 3 is filled with the cooling medium. The cooling medium led into the internal space 3*b* is returned from a connection point T2 to the cooling unit 21 through a pipe P104.

In other words, in the cooling mechanism shown in FIG. 4, the pipes P101, P102 and P103 respectively connect the space between the radiator (heat exchanger) 21*b* of the cooling unit 21 and inlet port C111 (first cooling path C101), the space between the outlet port C112 (first cooling path C101) and inlet port C121 (second cooling path C102), and the space between the outlet port C122 (second cooling path C102) and inlet port C131 (third cooling path C103). The pipes P101 and P103 are partially exposed to the outside of the housing, but can be provided within the housing. The position (of the pipes) is not limited to the example shown in the drawing. Namely, any pipe or inlet and outlet ports are connected by a hose, and at least one end is removable.

With use of the cooling paths shown in FIG. 4, the cooling medium fed from the heat exchanger 21*b* first cools the rotary body 13*b* and fixed shaft 13*a*, which serve as a bearing unit of the rotary unit 13 generating a high heating value. This certainly prevents burning of the dynamic pressure fluid bearing. The area around the getter 31 and stator coil 19 is certainly cooled.

The stator 19 is immersed together with the X-ray tube main body 5 in the cooling medium in the housing 3, and preferably molded by a resin material having high electrical insulation, waterproof and thermal conductivity.

As a resin material usable for molding, there are epoxy resin, tar epoxy resin, polyimide resin, acrylic resin, fluoric resin, silicon resin and polyurethane resin. A mixed resin including one of these resins as a main component is also usable.

As described above, powder of alumina, aluminum nitride and boron nitride may be dispersed in the resin in order to increase the thermal conductivity of the molding material.

This prevents deterioration of electrical insulation around the stator 19 without contacting the water-based cooling medium.

In the X-ray apparatus shown in FIG. 4, solely one kind of water-based cooling medium may be used as a cooling medium. This can decrease the cost and facilitate maintenance. A water-based cooling medium has a high heat transfer rate compared with insulating oil, and can efficiently radiate the heat of the whole apparatus.

Further, a water-based cooling medium has a small viscosity coefficient compared with insulating oil (non-oil/fat cooling medium). This decreases the load of the pump 21*a*. Therefore, the flow rate of circulating a cooling medium is stabilized. Further, the cooling capacity of a cooling medium is increased by the cooling mechanism. This decreases the possibility of damaging (burning) the dynamic pressure fluid bearing that is considered to have a relatively large load.

Figure 5:
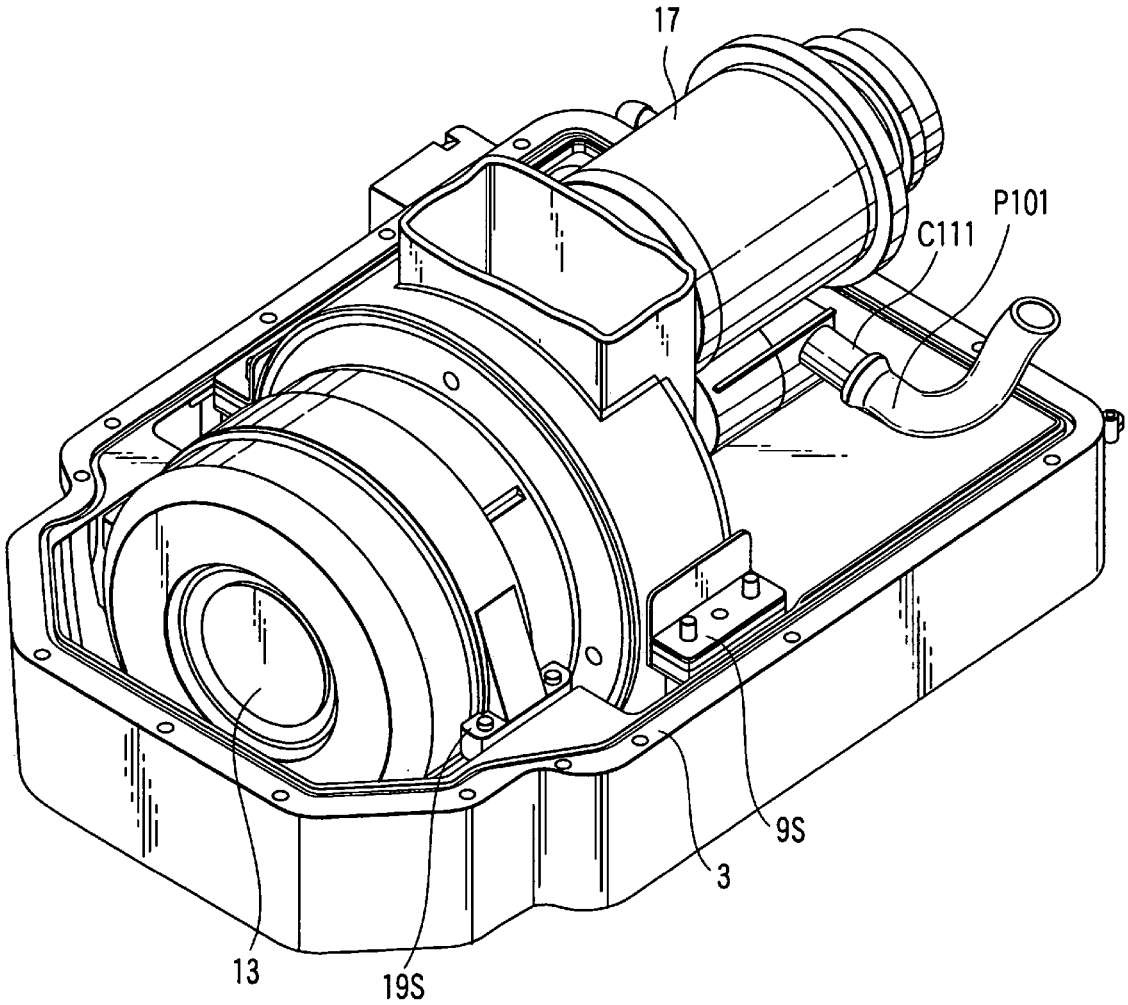
FIG. 5 is a schematic diagram of the X-ray apparatus shown in FIG. 4, in the state that a part of a housing is removed for explaining the internal structure.

FIG. 5 shows the state of the X-ray apparatus shown in FIG. 4, with a part of the housing removed for explaining the internal structure.

As shown in FIG. 5, the molding material 119*m* provided at a specified position around the stator coil 19 also serves as a fixing block 19*s* to fix the stator coil 19 (X-ray tube main body 5) to the housing 3. Of course, the fixing block 19*s* may be separated from the part used for molding the electric wire material 19I.

A fixing block 9*s* usable when fixing the enclosure 9 of the X-ray tube main body 5 to the housing 3 may be formed integrally with the enclosure 9 at a specified position of the enclosure 9, in a step of supplying a molding material used for molding an optional electric wire material (FIG. 5 shows the state that the mold is already formed.)

As describe above, it is also possible to place a molding material used for molding at a specified position of the enclosure 9 or in an area different from an area indispensable for molding an electric wire material, when molding the electric wire materials for the stator coil 19 and getter 31, and use that (molded) part as a positioning part (fixed block) for fixing the housing 3 to the enclosure 9 and stator coil 19.

By forming the positioning part (fixed block) for fixing the housing to the enclosure and stator coil as one body with a molding material, the number of man-hours for building up the X-ray apparatus can be decreased, and the X-ray tube main body (enclosure) can be precisely set (built up) in the housing. Further, by providing a fixed block in the enclosure and status coil by molding, the influence of external force acting on the X-ray tube main body can be absorbed within the housing, and damage during transportation can be decreased.

The present invention is not restricted to the above-mentioned embodiments as they are and their constituent elements can be variously modified/embodied without departing from the essence of the present invention. Various embodiments of the present invention can be achieved by properly combining a plurality of constituent elements disclosed in the embodiments. For example, some constituent elements may be eliminated from all the constituent elements of the embodiments of the present invention.

As explained hereinbefore, according to the present invention, a heat generated in a heating component can be efficiently exhausted (cooled) without lowering the insulation of the cooling liquid by using an oil/fat-based cooling liquid, even if an electric wire material used inside includes impregnant varnish. Therefore, the characteristics of the X-rays radiated from the X-ray tube can be maintained stable for a long period.

According to the present invention, a noise (electromagnetic noise) generated by flowing a current in the stator coil can be decreased.

Further, according to the present invention, a cooling medium with a high cooling efficiency can be used without considering the insulation (conductivity) of the cooling liquid, and the cooling efficiency is increased.

According to the present invention, stable characteristics can be ensured for a long period in an X-ray apparatus which cools a rotary anode X-ray tube by using a cooling medium. Therefore, the life of an X-ray image diagnostic apparatus and a non-destructive inspection apparatus incorporating with the X-ray apparatus is increased. Further, as the life of the X-ray apparatus itself is increased, the running costs of an X-ray image diagnostic apparatus and a non-destructive inspection apparatus are also decreased.

What is claimed is:

1. An X-ray apparatus comprising:

an anode target which generates X-rays;

an electron radiation source which generates an electron to the anode target;

a rotor which is connected to the anode target;

a stator coil which generates a driving force to rotate the rotor;

an enclosure which maintains at least the anode target, electron radiation source and rotor in a specified vacuum;

a housing around the enclosure which contains a cooling medium that contains water as a main component; and an electric wire material which supplies power to the stator coil, wherein a molding material is provided at a specified position to prevent the cooling medium from contacting the electric wire material.

2. The X-ray apparatus according to claim 1, wherein the molding material includes a resin having an electrical insulating property.

3. The X-ray apparatus according to claim 2, wherein the molding material includes an electrical insulating material to increase thermal conductivity.

4. The X-ray apparatus according to claim 1, wherein the cooling medium includes a mixture of glycol including water as a main component.

5. The X-ray apparatus according to claim 1, wherein the cooling medium is cooled and circulated by a cooling unit.

6. The X-ray apparatus according to claim 5, wherein the cooling medium is circulated in the vicinity of at least the anode target and electron radiation source.

7. An X-ray apparatus comprising:

a rotary anode target;

an electron radiation source which generates an electron to the rotary anode target;

a rotor which is connected to the rotary anode target;

a stator coil which generates a driving force to rotate the rotor;

an enclosure which maintains at least the rotary anode target, electron radiation source and rotor in specified vacuum;

a housing which contains a cooling medium, that includes water as a main component, around the enclosure;

an electric wire material which supplies power to the stator coil, or a connector used for connection with the electric wire material; and a molding material which prevents the cooling medium from contacting the electric wire material and/or any area of the stator coil.

8. The X-ray apparatus according to claim 7, wherein the cooling medium is cooled and circulated by a cooling unit.

9. The X-ray apparatus according to claim 8, wherein the cooling medium is circulated in the vicinity of at least the rotary anode target and electron radiation source.

10. An X-ray apparatus comprising:

a rotary anode target; an electron radiation source which generates an electron to the rotary anode target;

a rotor which is connected to the rotary anode target;

a stator coil which generates a driving force to rotate the rotor;

an enclosure which maintains at least the rotary anode target, electron radiation source and rotor in specified vacuum;

a housing which contains a cooling medium, that includes water as a main component, around the enclosure; and an electric wire material which supplies power to the stator coil, or a connector used for connection with the electric wire material, wherein the electric wire material and/or any area of the stator coil is molded by a material having electrical insulating property.

* * * * *